US006027033A

United States Patent [19]

Vanhonacker

[11] Patent Number: 6,027,033

[45] Date of Patent: Feb. 22, 2000

[54] METHOD AND DEVICE FOR MOUNTING TRACK RAILS

[76] Inventor: Patrick Vanhonacker, Konijnenpijp 5, B-3210, Linden, Belgium

[21] Appl. No.: 08/981,815

[22] PCT Filed: Apr. 30, 1997

[86] PCT No.: PCT/BE97/00055

§ 371 Date: Dec. 30, 1997

§ 102(e) Date: Dec. 30, 1997

[87] PCT Pub. No.: WO97/42376

PCT Pub. Date: Nov. 13, 1997

[30] Foreign Application Priority Data

May 3, 1996 [BE] Belgium ..... 09600397

[51] Int. Cl.[7] ..... E01B 19/00

[52] U.S. Cl. ..... 238/382; 238/2

[58] Field of Search ..... 238/382, 2, 3, 238/5, 6, 7, 342, 345, 349

[56] References Cited

U.S. PATENT DOCUMENTS

| | | | |
|---|---|---|---|
| 4,266,719 | 5/1981 | Ortwein et al. | 238/382 |
| 4,316,578 | 2/1982 | Reynolds et al. | 238/382 |
| 5,203,501 | 4/1993 | Vanotti | 238/382 |

*Primary Examiner*—Robert J. Oberleitner
*Assistant Examiner*—Robert J. McCarry, Jr.
*Attorney, Agent, or Firm*—Meroni & Meroni; Charles F. Meroni, Jr.

[57] ABSTRACT

In a device for fixing a rail resting on a support by means of an anti-vibration pad, a prestress is applied to this pad so that the operating point of the anti-vibration pad (2) always remains in the region of linear behaviour of the said anti-vibration pad in order to limit the static rail deflections while providing the desired anti-vibration isolation.

5 Claims, 2 Drawing Sheets

METHOD AND DEVICE FOR MOUNTING TRACK RAILS

The present invention falls within the field of devices for supporting the rails of a railway. It relates more particularly to a method for fixing a rail.

Current devices for fixing a rail include at least one pad made of elastic material which gives elasticity to the wheel/rail assembly so that a degree of vibratory isolation of the dynamic forces with respect to the environment is obtained.

There is almost always an elastic stage (a quite rigid pad) directly beneath the rail. There is often a second, more flexible pad beneath a metal sole-plate or a sleeper. The latter pad provides anti-vibration isolation.

The first resonant frequency, in flexure, of the wheel/rail assembly depends on the dynamic stiffness of the pads. This resonant frequency is inversely proportional to the anti-vibration performance of the rail-fixing system: a low resonant frequency gives better anti-vibration isolation than a high resonant frequency.

With pads which have a low dynamic stiffness, the first resonant frequency of the wheel/rail assembly is reduced, thereby giving rise to a good anti-vibration filter. The best filter is therefore obtained with the lowest dynamic stiffness of the pads.

However, there is a lower physical limit to this dynamic stiffness of the pads used in the current rail-fixing systems. The dynamic stiffness is directly proportional to the static stiffness of the pads. The static stiffness of the pads cannot be too low because of the fact that it has a direct influence on the deflection of the rails when vehicles are running along the rails. This rail deflection is generally limited to approximately 3 mm. For most current fixing devices, the resonant frequency lies between 35 Hz and 60 Hz.

This static rail deflection limit imposes a minimum static stiffness, and thus a minimum dynamic stiffness of the pad. This phenomenon limits the anti-vibration isolation performance of the current rail-fixing systems.

In order to achieve a superior isolation performance to that obtained with the conventional fixing systems, it is necessary for the fixing and isolating functions to be completely decoupled: this is realized in systems of the floating-slab type in which the rails are fixed to a slab which is itself isolated from the environment by anti-vibration studs between the slab and the bed (or floor). In the case of a floating slab, the resonant frequency lies between approximately 10 Hz and 25 Hz, which gives a better anti-vibration filter. The latter systems are, however, very expensive and difficult to maintain.

The object of the present invention is to give the rail-fixing devices an anti-vibration isolation performance close to that obtained with a floating slab and at the same time to ensure good rail stability.

This objective is achieved according to the invention by a novel method for fixing a rail, as defined in the claims. The anti-vibration pad is subjected to a significant preload, this preload being such that the anti-vibration pad works in its region of linear behaviour. When a wheel passes over the rail above a fixing device, the load becomes greater, but the anti-vibration pad continues to operate in its region of linear behaviour. The static rail deflections are thus limited, while providing the desired anti-vibration isolation. The method according to the invention for fixing the rail thus provides a high apparent static stiffness with a low dynamic stiffness.

The invention is explained in more detail in the description which follows, with reference to the appended drawings.

Figure 1:
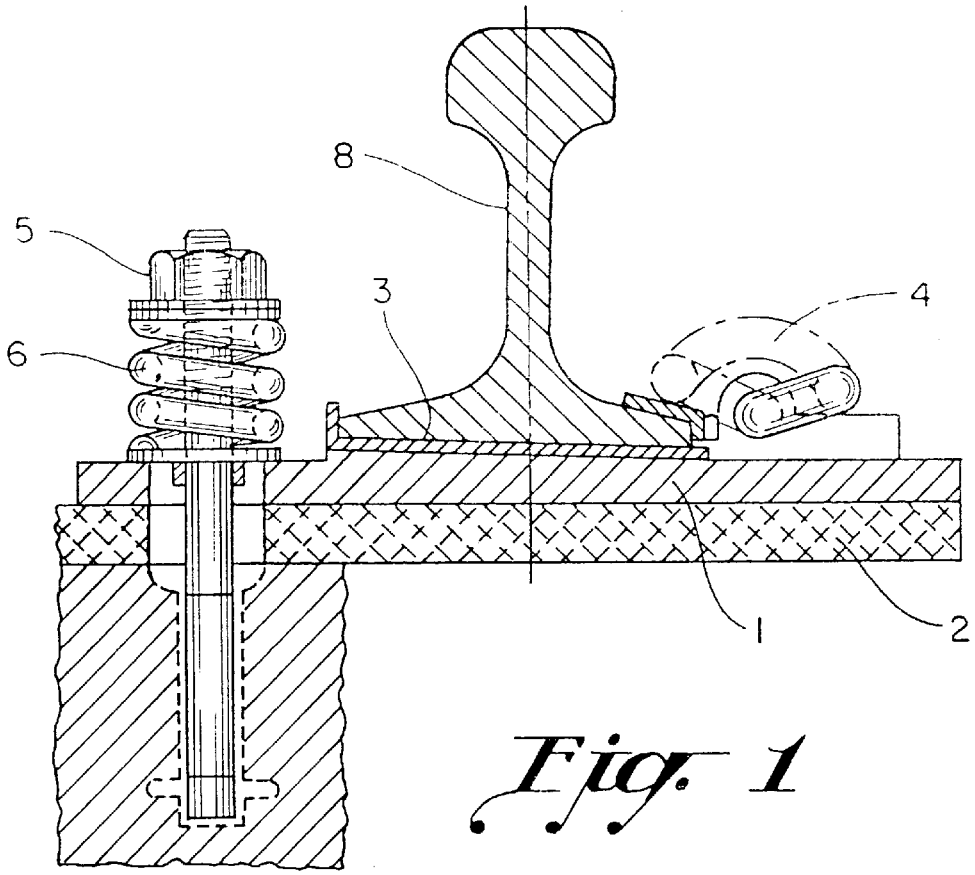
FIG. 1 shows a typical rail-fixing device.
Figure 1A:
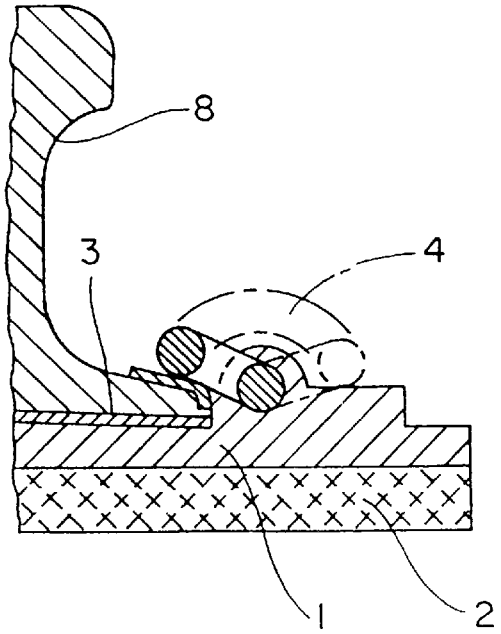

Referring to FIG. 1, a typical rail-fixing device, having two elastic stages, comprises the following members:

1. metal sole-plate
2. anti-vibration pad under the sole-plate (optionally under the sleeper)
3. anti-vibration pad under the rail
4. fastening clip
5. anchoring bolt
6. spring
7. electrical insulation
8. rail
9. concrete, wood, steel, etc.

Figure 2:
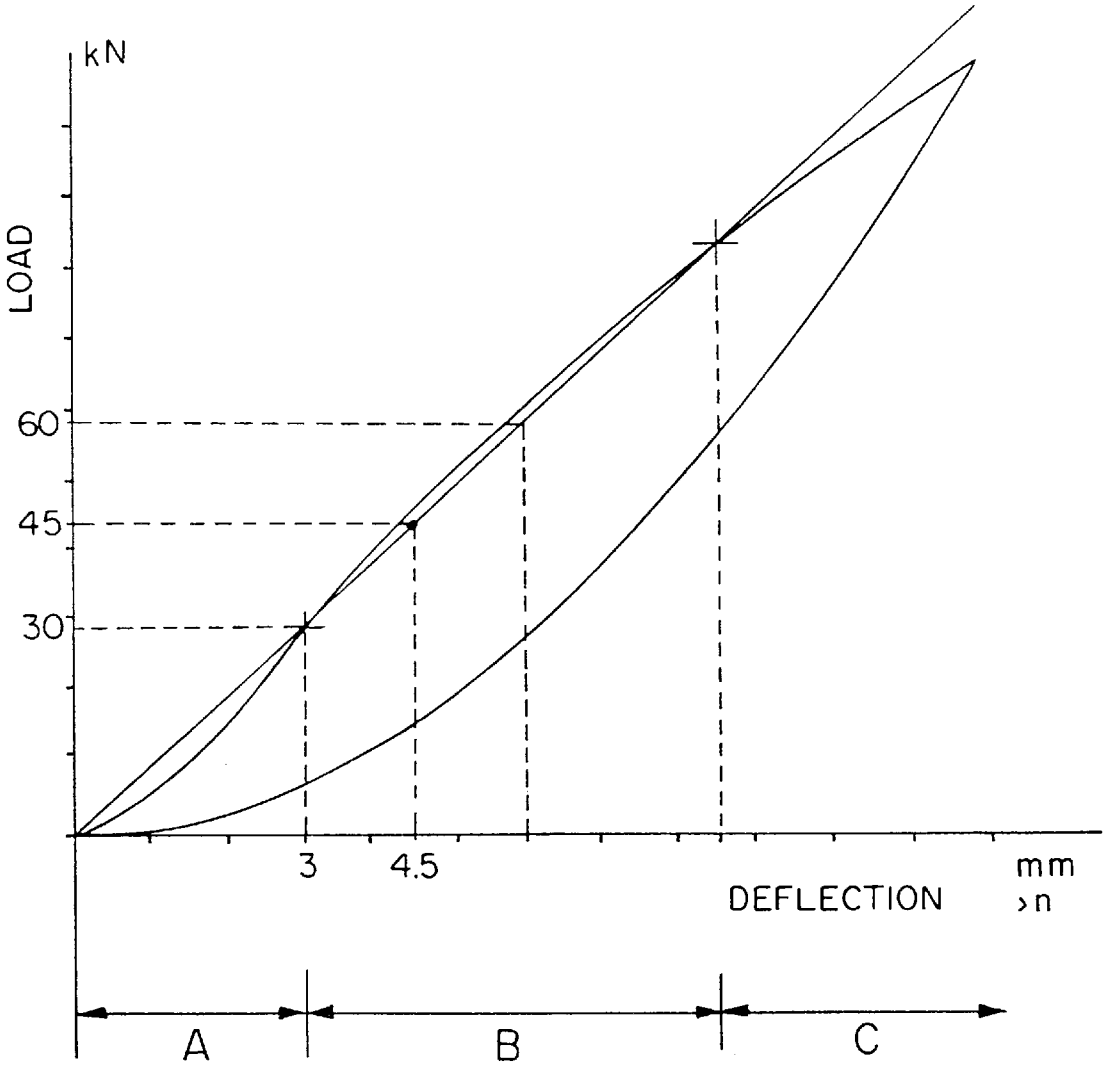
FIG. 2 shows a typical static deflection curve for an anti-vibration pad.

The anti-vibration pads have a static deflection curve as shown in FIG. 2. Three regions may be distinguished in this curve:

1. a non-linear loading region (A),
2. a linear region (B) in which the product has to operate,
3. a non-linear region (C) which cannot be used.

It is important for the product always to work in the linear region because of the fact that the actual load is quasi-static and rapid (the passage of wheels). This avoids passing every time into the non-linear loading region.

According to the invention, when fixing a rail, the anti-vibration pad 2 is subjected to a preload such that the pad 2 always works in its region of linear behaviour (region B in FIG. 1).

The significant prestress (a few tens of thousands of newtons) applied to the pad is created by two or four springs which apply a prestress to the anti-vibration pad between the sole-plate or the sleeper and the bed. This prestress may also be created by the clips in the case of a fixing system having a single elastic stage.

It should be noted that rail-fixing systems having two elastic stages with springs already exist, but the sole purpose of which is to keep the sole-plate or sleeper mechanically in place and to allow deflection of the sole-plate. The prestress in these springs is, however, only a few thousands of newtons.

In accordance with the invention, based on the technical data with regard to the rail track bed and to the rolling stock, the rail-fixing device is defined by taking into account, in the first place, the desired anti-vibration isolation performance (or wheel/rail resonant frequency). In general, this performance necessitates a low dynamic stiffness.

The desired static stiffness (which depends on the material of the pad) is derived from this dynamic stiffness. This static stiffness generally results in significant static displacements of the rail, which are not tolerated. The pad is given a prestress which is such that the difference between the rail displacement before prestress and after prestress remains less than the tolerated rail displacement (in general, 3 mm). Preferably, the pad is chosen in such a way that it works in its linear region with the prestress and the additional load which is added on top of it when a wheel passes.

In the case of a system for fixing a rail of the UIC 60 type on concrete, a sleeper spacing of 60 cm, an unsprung vehicle mass of 1000 kg, an axle load of 180 kN and a resonant frequency of the wheel/rail assembly of 22 Hz (an isolation similar to the floating-slab situation), a dynamic stiffness of the elastic pad in the fixing system of approximately 10 kN/mm (calculation using the finite-element method) is necessary.

By using a product, for the anti-vibration pad, having a static stiffness equal to the dynamic stiffness, a rail deflection of 4.5 mm is obtained with the axle load in question. For example, it is possible to use a quasi-isotropic microcellular product, such as polyurethane with a hybrid structure.

If the pad is given a prestress of about 30 kN, which corresponds to approximately 3 mm of deflection, the rail deflection when a wheel passes is about 1.5 mm, which is entirely acceptable. However, the system remains dynamically very flexible.

I claim:

1. A method for fixing a rail on a support, said method comprising:

placing a support on a ground;

placing a first anti-vibration pad on said support;

placing a metal sole-plate on said first anti-vibration pad;

placing a second anti-vibration pad on said metal sole-plate;

placing a rail on said second anti-vibration pad;

fixing said rail on said support by means of a first fastening means applied to said rail along a first lateral side thereof;

fixing said first anti-vibration pad and said metal sole-plate on said support by means of a second adjustable fastening means acting directly on said metal sole-plate;

adjusting said second adjustable fastening means thereby to apply predetermined preload stress to said first anti-vibration pad so that the operating point of said first anti-vibration pad always remains in the region of linear behaviour of its static deflection curve during the passage of wheels on the rail.

2. A method for fixing a rail on a support according to claim 1, wherein the preload stress applied to said spring ranges from 20 kN to 100 KN.

3. A method for fixing a rail on a support according to claim 2, wherein the preload stress applied to the spring equals 30 kN.

4. A device for fixing a rail on a support comprising:

a support provided to be placed on a ground;

a first anti-vibration pad provided to be placed on said support;

a metal sole-plate provided to be placed on said first anti-vibration pad;

a second anti-vibration pad provided to he placed on said metal sole-plate, on a location provided for applying said rail;

a first fastening means applied to said rail along a lateral side thereof;

a second adjustable fastening means acting directly on said metal sole-plate, said second adjustable fastening means being adjustable to apply a predetermined preload stress to said first anti-vibration pad.

5. A device according to claim 4, wherein said first anti-vibration pad is made of a compound having a static stiffness and a dynamic stiffness substantially equal.

* * * * *